United States Patent [19]

Horgan et al.

[11] 4,281,054

[45] Jul. 28, 1981

[54] OVERCOATED PHOTORECEPTOR CONTAINING INJECTING CONTACT

[75] Inventors: Anthony M. Horgan, Pittsford; Richard W. Radler, Marion, both of N.Y.

[73] Assignee: Xerox Corporation, Stamford, Conn.

[21] Appl. No.: 28,635

[22] Filed: Apr. 9, 1979

[51] Int. Cl.[3] ..... G03G 5/04

[52] U.S. Cl. ..... 430/59; 430/57; 430/58; 430/60; 430/65; 430/66

[58] Field of Search ..... 430/58, 57, 60, 59, 430/61, 62, 63, 64, 65, 66, 67

[56] References Cited

U.S. PATENT DOCUMENTS

| | | | |
|---|---|---|---|
| 3,041,167 | 6/1962 | Blakney et al. | 96/1 |
| 3,769,010 | 10/1973 | Hanada | 430/57 |
| 3,881,923 | 5/1975 | Tanaka | 430/58 |
| 3,915,076 | 10/1975 | Gotoda | 430/57 |
| 4,050,935 | 9/1977 | Limberg | 430/59 |
| 4,066,455 | 1/1978 | Mey et al. | 430/58 |
| 4,071,363 | 1/1978 | Jones | 96/1.5 R |
| 4,115,116 | 9/1978 | Stolka | 430/58 |
| 4,123,269 | 10/1978 | Von Hoene et al. | 430/60 |

FOREIGN PATENT DOCUMENTS

| | | | |
|---|---|---|---|
| 2723925 | 12/1977 | Fed. Rep. of Germany | 430/60 |
| 38-17247 | 9/1963 | Japan | 430/65 |
| 38-20697 | 10/1963 | Japan | 430/65 |

*Primary Examiner*—Mary F. Downey

*Attorney, Agent, or Firm*—E. O. Palazzo

[57] ABSTRACT

An imaging member which is comprised of a substrate, an injecting contact, or hole injecting electrode overlaying the substrate, a charge transport layer comprised of an electrically inactive organic resin having dispersed therein an electrically active material, a combination of which is substantially non-absorbing to visible electromagnetic radiation but allows the injection of photogenerated holes from a charge generator layer in contact with the injecting contact and electrically induces holes from the layer of injecting material, a layer of charge generator material on and in operative connection with the charged transport layer and finally a layer of insulating organic resin overlaying the layer of charge generating material. The hole injecting electrode includes materials such as trigonal selenium, selenium dioxide, arsenic, tellurium, and alloys of selenium such as arsenic-selenium-tellurium.

11 Claims, 4 Drawing Figures

OVERCOATED PHOTORECEPTOR CONTAINING INJECTING CONTACT

This invention is generally concerned with an electrophotographic imaging device and a method of imaging utilizing such device. More specifically, the present invention is directed to an overcoated photoreceptor containing as one of its essential layers an injecting contact.

Electrophotography, and more specifically, xerography, is well known and processes employing this technology generally involve the formation of an electrostatic latent image on the surface of a photosensitive plate which image can be developed by a toner if desired. This developed image can then be transferred to a receiver member such as substrate with subsequent fusing of the toner. Of course the electrostatic latent image can also be used for electrostatic scanning systems wherein the latent image can be read or transferred to other materials by TESI techniques and stored.

Numerous different types of photoreceptors can be used in the electrophotographic process including both organic materials, inorganic materials and mixtures thereof. There are known photoreceptors wherein the charge carrier generation and charge carrier transport functions are accomplished by discrete contiguous layers and further there have been described photoreceptors which included overcoated layers of an electrically insulating polymeric material and in conjunction with this overcoated type photoreceptor there have been proposed a number of imaging methods. The art of electrophotography in xerography continues to advance and many more specific demands need to be met by the copying apparatus in order to increase performance standards, and to obtain higher quality images over a long period of time. Further there is needed an acceptable overcoating for the photoreceptor for protection purposes.

There is described in U.S. Pat. No. 3,041,167 an electrophotographic imaging method which employs an overcoated imaging member containing a conductive substrate, a photoconductive insulating layer and an overcoating layer of an electrically insulating polymeric material. This member can be used in an electrophotographic copying method for example, by initially charging the member with an electrostatic charge of a first polarity and imagewise exposing to form an electrostatic latent image which can then be removed to form a visible image. The visible image can be transferred to a receiver member and the surface of the imaging member can be cleaned. Prior to each succeeding cycle the imaging member can be charged with an electrostatic charge of a second polarity which is opposite in polarity to the first polarity. Additional sufficient charges of the second polarity are applied so as to create across the member a net electrical field of a second polarity. Simultaneously, mobile charges of the first polarity are created and the photoconductive layer such as by applying an electrical potential to the conductive substrate.

Many imaging methods can be used with such photoreceptors such as those described by Mark in an article appearing in *Photographic Science and Engineering*, Vol. 18, No. 3, pages 254–261, May/June, 1974. These imaging methods require the injection of majority carriers, or photoconductors possessing ambipolarity properties.

Also such methods may require systems where bulk absorption of light occurs.

SUMMARY OF THE INVENTION

It is an object of the present invention to provide an improved photoreceptor device which contains as one of its layers an injecting contact or hole injecting electrode.

Yet another object of this invention is the provision of an injecting contact at the interface between a photoconductive layer and a supporting substrate which contact injects positive charges into the subadjacent layer.

These and other objects of the present invention are accomplished by providing an imaging member which is comprised of a substrate, an injecting contact, or hole injecting electrode overlaying the substrate, a charge transport layer comprised of an electrically inactive organic resin having dispersed therein an electrically active material, a combination of which is substantially non-absorbing to visible electromagnetic radiation but allows the injection of photogenerated holes from a charge generator layer in contact with the injecting contact and electrically induces holes from the layer of injecting material, a layer of charge generator material on and in operative connection with the charged transport layer and finally a layer of insulating organic resin overlaying the layer of charge generating material.

The above described layered structure and specifically the injecting contact material can be formed by any one of a number of processes provided that the desired electrical and mechanical properties are obtained. In one process of formation there is first applied an injecting contact layer to a supporting base in fluid form, evaporating the solvent of liquid carrier to solidify the hole injecting layer, followed by application of the charge carrier layer to the injecting contact material in fluid form and evaporating off the liquid carrier of this overcoating. After final curring and cooling of the composite mechanical integrity is obtained between the injecting contact and the substrate and the hole injecting layer and the charge carrier layer.

In one method of operation the layer structure is charged a first time with electrostatic charges of negative charge polarity, subsequently charged a second time with electrostatic charges of a positive polarity for the purposes of substantially neutralizing the charges residing on the electrically insulating surface of the member and subsequently exposing the member to an imagewise pattern of activating electromagnetically radiation thereby forming an electrostatic latent image. This image can then be developed to form a visible image which is transferred to a receiving member. The imaging member may subsequently be reused to form additional reproducations after the erase and cleaning steps are accomplished.

BRIEF DESCRIPTION OF THE DRAWINGS

A better understanding of the present invention and further features thereof can be obtained by referring to the following description of various preferred embodiments wherein.

DESCRIPTION OF THE PREFERRED EMBODIMENTS

Figure 1:
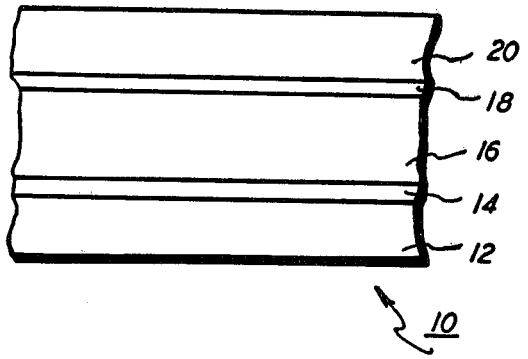
FIG. 1 is a partially schematic cross-sectional view of the photoreceptor device of the present invention.

Illustrated in FIG. 1 is a photoreceptor generally designated 10 comprising a substrate 12, an injecting contact material or hole injecting electrode 14, a layer of charge carrier transport material 16, a layer of photoconductive charge carrier generating material 18 and a layer of electrically insulating polymeric material 20.

Substrate 12 may be opaque or substantially transparent and may comprise any suitable material having the requisite mechanical properties. The substrate may comprise a layer of non-conducting material such as an inorganic or organic polymeric material; a layer of an organic or inorganic material having a conductive surface layer arranged thereon or a conductive material such as, for example, aluminum, brass, stainless steel, nickel or the like. The substrate may be flexible or rigid and may have any of many different configurations such as, for example, a plate, a cylindrical drum, a scroll, an endless flexible belt, webs, plates and the like. Preferably, the substrate is in the form of an endless flexible belt. The substrate or support may also comprise a composite structure such as a thin conductive coating contained on a paper base; a plastic coated with a thin conductive layer such as aluminum or copper iodide; or glass coated with a thin conductive coating of chromium or tin oxide.

The thickness of the substrate layer depends on many factors including mechanical and economical considerations and this layer may be of substantial thickness, for example, over 100 mils or minimum thickness providing there are no adverse effects on the system. In one preferred embodiment this thickness ranges from about 3 mils to about 10 mils.

Injecting contact material or hole injecting electrode 14 must be capable of injecting charge carriers or holes into charge carrier transport layer 16 under the influence of an electrical field in the preferred embodiment of the invention. As will be discussed in detail herein, the injected charge carriers must be of the same polarity as the mobile carriers preferentially transported by layer 16. In one embodiment, the charge carrier injecting layer may be sufficiently laterally conductive to also serve as the ground electrode for the photoreceptor, in which case a separate additional conductive layer is not required.

The injecting contact can comprise a number of materials capable of injecting positive charges into the transport layer, such materials being, for example, trigonal selenium, acceptor doped trigonal selenium such as a chlorine doped trigonal selenium material, selenium dioxide, arsenic, tellurium, alloys of selenium such as arsenic-selenium, selenium-tellurium, arsenic-selenium-tellurium; and the like. The preferred injecting contact in one embodiment is trigonal selenium, selenium dioxide, arsenic or tellurium.

The injecting contact or hole injecting electrode has a thickness in the range of from about 1 to about 20 microns or more with the preferred range being from about 2 microns to about 10 microns. The maximum thickness is generally determined by the mechanical properties desired. The charge carrier injecting materials and charge carrier transport materials require a particular work function relationship in order that the holes or electrons to be injected from the former into the latter can be effectively accomplished. Normally the hole injecting materials have a relatively high work function whereas electron injecting materials have a relatively low work function.

The charge carrier transport layer 16 can be any number of suitable materials which are capable of transporting holes, this layer having a thickness in the range of from about 5 to about 50 microns and preferably from about 20 to about 40 microns. In a preferred embodiment this transport layer comprises molecules of the formula:

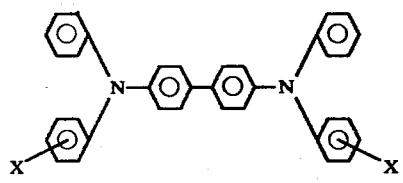

dispersed in a highly insulating and transparent organic polymeric material wherein X is selected from the group consisting of (ortho)$CH_3$, (meta)$CH_3$, (para)$CH_3$, (ortho)Cl, (meta)Cl, (para)Cl. This charge transport layer, which is described in detail in copending application Ser. No. 716,403 (series of 1970) filed by Milan Stolka et al. on Aug. 23, 1976, and totally incorporated herein by reference, is substantially non-absorbing in the spectral region of intended use, i.e., visible light, but is "active" in that it allows injection of photogenerated holes from the charge generator layer and electrically induced holes from the injecting electrode. The highly insulating polymer, which has a resistivity of at least $10^{12}$ ohm-cm to prevent undue dark decay, is a material which is not necessarily capable of supporting the injection of holes from the injecting or generator layer and is not capable of allowing the transport of these holes through the material. However, the polymer becomes electrically active when it contains from about 10 to 75 weight percent of the substituted N,N,N',N'-tetraphenyl-[1,1'-biphenyl]4-4'-diamines corresponding to the foregoing formula. Compounds corresponding to this formula include, for example, N,N'-diphenyl-N,N'-bis-(alkyl-phenyl)-[1,1-biphenyl]-4,4-diamine wherein the alkyl is selected from the group consisting of methyl such as 2-methyl, 3-methyl and 4-methyl, ethyl, propyl, butyl, hexyl and the like. In the case of chloro substitution, the compound is named N,N'-diphenyl-N,N'-bis(-halo phenyl)-[1,1'-biphenyl]-4,4'-diamine wherein the halogen atom is 2-chloro, 3-chloro or 4-chloro.

Other electrically active small molecules which can be dispersed in the electrically inactive polymer to form a layer which will transport holes include triphenylmethane, bis-(4-diethylamino-2-methylphenyl)-phenylmethane; 4',4'-bis(diethylamino)-2,2'-dimethyltriphenyl methane; bis-4-(-diethylamino phenyl)-phenylmethane; and 4,4'-bis(diethylamino)-2,2'-dimethyltriphenylmethane. Other active small molecules include those described in U.S. Pat. No. 4,047,948 such as N,N'-dipehnyl-N,N'-bis(phenyl methyl)-[1,1'-biphenyl]-4,4'diamine, N,N'-diphenyl-N,N'bis-(2-methyl phenyl)-[2,2'-dimethyl-1,1'-biphenyl]4,4'-diamine, N,N'-diphenyl-N,N'-bis-(alkyl phenyl)[1,1'-biphenyl]-4 4-'diamine, bis-(4-diethyl amino-2-methyl phenyl)phenyl methane and the like.

Transport layer 16 may comprise any electrically inactive binder polymeric material such as those described by Middleton et al., in U.S. Pat. No. 3,121,006, incorporated herein by reference. The polymeric binder contains from 10 to 75 weight percent of the active material corresponding to the foregoing formula and preferably from about 35 to about 50 weight percent of this material. Typical organic polymeric materials useful as the binder include polycarbonates, acrylate polymers, vinyl polymers, cellulose polymers, polyesters, polysiloxanes, polyamides, polyurethanes and epoxies as well as block random or alternating copolymers thereof. The materials most preferred as the electrically inactive resinous material is poly(4,4'-isopropylidene-diphenylene carbonate) with a molecular weight ($M_w$) of from about 35000 to about 40000 available as Lexan® 145 from General Electric Company; poly(4,4'-isopropylidene-diphenylene carbonate) with a molecular weight ($M_w$) of from about 40,000 to about 45,000 available as Lexan® 141 from the General Electric Company; a polycarbonate resin having a molecular weight ($M_w$) of from about 50,000 to about 100,000, available as Makrolon® from Farbenfabricken Bayer A.G. and a polycarbonate resin having a molecular weight ($M_w$) of from about 20,000 to about 50,000, available as Merlon® from Mobay Chemical Company.

Photoconductive charge carrier generating layer 18 generally may comprise any photoconductive charge carrier generating material known for use in electrophotography provided it is electronically compatible with the charge carrier transport layer and the charge carriers can travel in both directions across the interface between the two layers. Particularly preferred photoconductive charge carrier generating materials include materials such as phthalocyanines like metal free, for example, the X-form of phthalocyanine, or metal phthalocyanines including vanadyl phthalocyanine. These materials can be used alone or as a dispersion in a polymeric binder. Layer 18 is typically from about 0.5 to about 10 microns or more in thickness. Generally, it is desired to provide this layer in a thickness which is sufficient to absorb at least 90 percent (or more) of the incident radiation which is directed upon it in the imagewise exposure step. When using a binder configuration, photoconductive particles are dispersed randomly without orientation in a matrix material. The photoconductive particles may consist of any suitable inorganic or organic photoconductor and mixtures thereof. Inorganic materials include organic crystalline compounds such as cadmium sulfoselenide, cadmium selenide, cadmium sulfide, and mixtures thereof. Typical inorganic photoconductive glasses include amorphous selenium, and selenium alloys such as selenium tellurium, selenium-arsenic and selenium-tellurium-arsenic. Selenium may also be used in a crystalline form known as trigonal selenium, which in one preferred embodiment has a thickness of 0.03 to 0.8 microns. Typical organic photoconductive materials include phthalocyanine described in U.S. Pat. No. 3,357,989 to Byrne et al. The above list of photoconductors should in no way be taken as limiting, but is merely illustrative of suitable materials.

The binder material may comprise any suitable film forming organic resin, an electrically active organic material, or a photoconductive materials.

In another embodiment of the instant invention, the binder structure is modified to insure that the photoconductive particles are in the form of continuous chains through the thickness of the binder layer. This type of photoconductive layer is more fully described in U.S. Pat. No. 3,787,208, which is incorporated herein by reference.

Alternatively, the photoconductive layer may consist entirely of a substantially homogeneous photoconductive material such as a layer of amorphous selenium, a selenium alloy such as selenium-tellurium, selenium-arsenic and selenium-tellurium-arsenic, trigonal selenium or a powdered or sintered photoconductive layer such as a cadmium sulfoselenide or phthalocyanine.

Electrically insulating overcoating layer 20 typically has a bulk resistivity of from about $10^{12}$ to about $5\times10^{14}$ ohm-cm and typically is from about 5 to about 75 microns and preferably from about 5 to about 25 microns in thickness. Generally, this layer provides a protective function in that the charge carrier generating layer is kept from being contacted by toner and ozone which is generated during the imaging cycles. The overcoating layer also must prevent charges from penetrating through it into charge carrier generating layer 18 or from being injected into it by the latter. Preferably, therefore, layer 20 comprises materials having higher bulk resistivities. Generally, the minimum thickness of the layer in any instance is determined by the functions the layer must provide whereas the maximum thickness is determined by mechanical considerations and the resolution capability desired for the photoreceptor. Typical suitable materials include Mylar (a polyethylene terephthalate film commercially available from E. I. duPont de Nemours), polyethylenes, polycarbonates, polystyrenes, polyurethanes and the like. The particular material selected in any instance should not be one which will substantially dissolve or react with the materials used in layers 16 and 18.

The formation of the electrically insulating layer 20 over the previous layer may be carried out by lamination or solution coating. Where layer 20 constitutes a preformed mechanically tough film, it is typically necessary to provide sufficient adhesive material in order to provide an integral structure which is desirable for use in a repetitive imaging method. The electrical properties of any such adhesive interlayer should be similar to those of the overcoating. Alternatively, they may be similar to the binder material of the charge carrier generating layer 18 where a binder material is present in that layer. Mechanically, the adhesive interlayer should provide an adhesive state that firmly binds the layers together without any air gaps or the like which could disturb image definition.

Figure 2A:
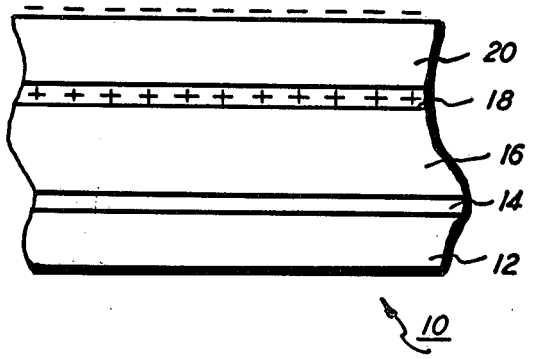
FIGS. 2*a* to 2*c* illustrate the various method steps used for causing the formation of an image with the overcoated photoreceptor device of the present invention.
Figure 2B:
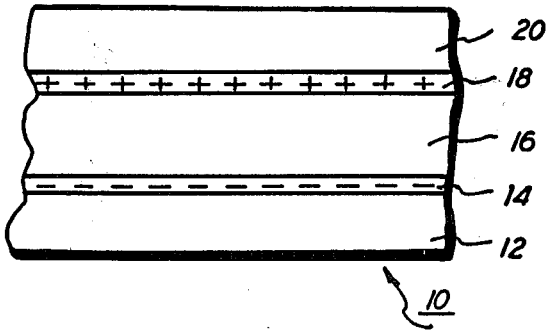
Figure 2C:
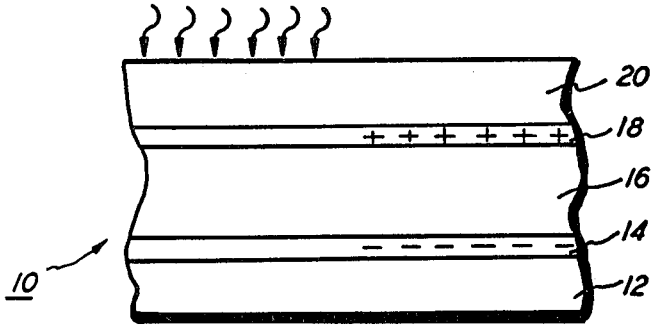

The operation of the member is illustrated with respect to FIGS. 2A–2C. In this illustrative explanation the charge carrier injecting material and the initial charging step is carried out with negative polarity. As noted previously, the method is not limited to this embodiment. Moreover, the description of the method will be given in conjunction with the proposed theoretical mechanism by which the method is thought to be operative in order to better aid those skilled in the art to understand and practice the invention. It should be noted, however, that the method has been proved to be operable and highly effective through actual experimentation and any inaccuracy in the proposed theoretical mechanism of operation is not to be construed as being limiting of the invention.

Referring now to FIG. 2A there is seen the condition of the photoreceptor after it has been electrically charged negatively a first time in the absence of illumination by any suitable electrostatic charging apparatus such as a corotron. The negative charges reside on the surface of electrically insulating layer 20. As a consequence of the charging, an electrical field is established across the photoreceptor and as a consequence of the electrical field, holes are injected from the charge carrier injecting electrode layer into the charge carrier transport layer. The holes injected into the charge carrier transport layer are transported through the layer, enter into the charge carrier generating layer 18 and travel through the latter until they reach the interface between the charge carrier generating layer 18 and the hole trapping layer where they become trapped. The charges are thus substantially trapped at the interface, and establish an electrical field across the electrically insulating layer 20, therefore, where negative charging is carried out in the first charging step, charge carrier injecting layer 14 and charge carrier transport layer 16 must comprise materials which will allow injection of holes from the former into the latter and charge transport layer 16 comprises materials which will predominantly transport holes. The charge carrier transport layer 16 and the charge carrier generating layer 18 must comprise materials which will allow injection of holes from the former into the latter and allow the holes to travel to the interface between layer 18 and hole trapping layer 19 or 21. Generally, the electrical field established by the first charging is in the range of from 10 volts/micron to about 100 volts/micron.

Subsequently, the member is charged a second time in the absence of illumination with a polarity opposite to that employed in the first charging step for the purpose of substantially neutralizing the charges residing on the surface of the member. The second charging of the member in this embodiment is effected with positive polarity. Subsequent to the second charging step, the surface of the photoreceptor should be substantially free of electrical charges. The substantially neutralized surface is created by selecting a charging voltage based on the dielectric thickness ratio of the overcoating layer 20 plus the hole trapping layer 19, or 21 and 22 to the total of the charge carrier transport and charge carrier generating layers 16 and 18 respectively. By substantially neutralized is meant that the voltage across the photoreceptor member upon illumination of the photoreceptor may be brought to substantially zero.

FIG. 2B illustrates the condition of the photoreceptor after the second charging step. In this illustration no charges are shown on the surface of the member. The positive charges residing at the interface of layers 18 and 20 as a result of the first charging step remain trapped at that interface at the end of the second charging step. However, there is now a uniform layer of negative charges located at the interface between layers 14 and 16.

Therefore it can be seen that the net result of the second charging step is to establish a uniform electrical field across the charge carrier transport and charge carrier generating layers. To achieve this result it is critical that the negative charges be located at the interface between charge carrier injecting layer 14 and charge carrier transport layer 16 and prevented from entering into the transport layer. For this reason it is preferred to utilize a charge carrier transport material which will transport only one species of charge carrier, holes in this illustrative instance. Where a charge carrier transport material capable of transporting both species of charge carriers is employed in layer 16 it is apparent that the charge carrier injecting material would have to be selected so that the latter would be unable to inject electrons in layer 16 thus placing constraints on the selection of materials.

Subsequently, the member is exposed to an imagewise pattern of electromagnetic radiation to which the charge carrier generating material comprising layer 18 is responsive. The exposure of the member may be effected through the electrically insulating overcoating. As a result of the imagewise exposure an electrostatic latent image is formed in the photoreceptor. This is because hole-electron pairs are generated in the light-struck areas of the charge carrier generating layer. The light generated holes are injected into the charge carrier transport layer and travel through it to be neutralized by the negative charges located at the interface between layers 14 and 16 wherein the light-generated electrons neutralize the positive charges trapped at the interface between layers 18 and 20. In the areas of the member which did not receive any illumination, the positive charges remain in their original position. Thus, there continues to be an electrical field across the charge carrier transport and charge carrier generating layers in areas which do not receive any illumination whereas the electrical field across the same layers in the areas which receive illumination is discharged to some low level.

The electrostatic latent image formed in the member may be developed to form a visible image by any of the well known xerographic development techniques, for example, cascade, magnetic brush, liquid development and the like. The visible image is typically transferred to a receiver member by any conventional transfer technique and affixed thereto. While it is preferably to develop the electrostatic latent image with marking material the image may be used in a host of other ways such as, for example, "reading" the latent image with an electrostatic scanning system.

When the photoreceptor is to be reused to make additional reproductions as is the case in a recyclible xerographic apparatus any residual charge remaining on the photoreceptor after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor while the photoconductive carrier generating layer is uniformly illuminated and grounded. For example, charge removal can be effected by A.C. corona discharge in the presence of illumination from a light source or preferably a grounded conductive brush could be brought into contact with the surface of the photoreceptor in the presence of such illumination. This latter mode also will remove any residual toner particles remaining on the surface of the photoreceptor.

The invention will now be described in detail with respect to specific preferred embodiments thereof, it being understood that these Examples are intended to be illustrative only and the invention is not intended to be limited to the materials, conditions, process parameters, etc., recited herein. All parts and percentages are by weight unless otherwise indicated.

EXAMPLE I

There was prepared an overcoated photoreceptor in accordance with the present invention by coating a hole injecting contact on a substrate and subsequently overcoating the injecting contact with a small molecule transport layer and a final overcoating of an insulating layer. There was coated on a substrate 5 mil thickness, an opaque aluminized Mylar, a polyethylene terephthalate resin commercially available from duPont Corporation, an adhesive of ½ mil wet thickness, this adhesive being obtained from a 0.5 percent weight volume of a duPont polyester 49000 in 4:1 $CH_2Cl_2$:1,1,2 trichloroethane. An alternative method is to add the DuPont 49,000 adhesive to the injecting contact mixture of a loading of 0.07 gm of 49,000 for each 0.8 gm of polyvinylcarbazole, thereby eliminating the separate interface layer. There was then dissolved in 14 milliliters of 1:1 tetrahydrofuran:toluene in a 2 ounce bottle 0.8 grams of purified polyvinylcarbazole. To this was added 3.13 grams of trigonal selenium, 50 percent by volume and 100 grams of ⅛ inch stainless steel shot. This mixture was ball-milled for 72 hours at 150 revolutions per minute and coated to a ½ mil wet thickness on the adhesive material with a Bird applicator. Alternatively, with the incorporation of the DuPont polyester 49,00 in the mixture, the coating is made on the substrate. This is followed by annealing at 100° C. for 18 hours in a vacuum, resulting in a dry thickness of 2–4 microns.

There was prepared a transport layer from a solution of a 50 to 50 by weight percent of N,N,N',N'-tetraphenyl-[1,1'-biphenyl]4-4'diamine to polycarbonate resin having a molecular weight of from about 50,000 to about 100,000 this material being commercially available as Makrolon from Farbenfabriken Bayer A. G. in $CH_2Cl_2$. The solid contents of this solution is about 15 percent by weight. This solution was then coated over the injecting layer with a Bird applicator resulting in a layer of 6 mil wet thickness over the injecting contact. Annealing for 18 hours at 70° C. in a vacuum was then accomplished. An approximately 0.6 micron thick amorphous arsenic triselenide generating layer was then vacuum deposited over the transport layer.

The overcoating insulating layer was then prepared by dissolving 7.5 grams of a polyester commercially available from Goodyear under the name Flexclad and 21 milliliters of $CHCl_3$. A 3 mil wet thickness of this material was coated from a Bird applicator on the generating layer which after drying resulted in a 12 micron dry thickness.

The photoreceptor was charged a first time with a surface charge density of about $1.0\times10^{-3}$ c/M$^2$ resulting in about −500 volts across the overcoating insulating layer and then charged a second time with a similar charge density of opposite polarity resulting in about +1,000 volts across the charge generator and charge transport layers. The photoreceptor was then uniformly illuminated with white light. Electrical measurements show that the field across the photoreceptor was discharged to substantially zero potential thus indicating that the photoreceptor is suitable for use according to the method of the present invention.

Alternatively the charge generating layer can be prepared in a similar manner with the exception that amorphous selenium (0.5 micron thick layer), trigonal selenium, less than 0.8 microns, or selenium-tellurium alloys was used in place of the arsenic triselenide. Similarly the charge generating layer can include materials such as phthalocyanines either alone or as a dispersion in a polymeric binder. Thus a charge carrier generating composition was prepared by mixing 0.7 grams of alpha metal free phthalocyanine and 1.5 grams of 49,000 polyester resin commercially available from E. I. DuPont and methylene chloride, followed by ball milling for about 78 hours. An approximately 3 micron thick layer of this composition was deposited over the transport layer by solvent coating using a draw bar coating technique, followed by drying to remove the methylene chloride solvent.

This procedure was repeated with the exception that in place of the alpha metal phthalocyanine there was used X-form of phthalocyanine, or vanadyl phthalocyanine.

EXAMPLE II

An overcoated photoreceptor was prepared in accordance with Example I with the exception that the injecting contact was prepared by dissolving 2.4 grams of purified polyvinylcarbazole and 66.7 milliliters of 1:1 tetrahydrofuran:toluene in a 4 ounce bottle. To this was added 300 grams of a ⅛ inch stainless steel shot and 9.6 grams of trigonal selenium which has been heat treated at 150° C. for 18 hours in a forced air oven, at a temperature of between about 125° C. and 250° C. This mixture was then ball-milled for 84 hours at 150 revolutions per minute. There was then coated using a Bird applicator a ½ mil wet thickness of this material on the interface layer which after being allowed to dry for 18 hours resulted in a layer having a dry thickness of 2–4 microns. Alternatively, with the incorporation of the DuPont polyester 49,000 in the mixture, the coating is made on the substrate.

The photoreceptor as prepared was charged in accordance with Example I and substantially similar results were obtained.

EXAMPLE III

There was prepared an overcoated photoreceptor in accordance with example I with the exception that the injecting contact was prepared by dissolving 2.4 grams of purified polyvinylcarbazole and 66.7 milliliters of 1:1 tetrahydrofuran:toluene in a 4 ounce bottle. To this was added 300 grams of ⅛ inch stainless steel shot and 9.6 grams of trigonal selenium 50 percent by volume. This mixture was ball milled for 84 hours at 150 revolutions per minute followed by coating a ½ mil wet thickness with a Bird applicator, this coating occurring on the interface. Alternatively, with the incorporation of the DuPont polyester 49,000 in the mixture, the coating is made on the substrate. After annealing at 150° C. for 18 hours in a forced air oven the dry thickness of this layer was 2–4 microns.

This photoreceptor was charged in accordance with Example I and substantially similar results were obtained.

EXAMPLE IV

An overcoated photoreceptor was prepared in accordance with Example I with the exception that the injecting contact was prepared by dissolving 0.8 grams of purified polyvinylcarbazole in 14 milliliters of 1:1 tetrahydrofuran:toluene in a 2 ounce bottle. To this was added 1.13 grams of selenium dioxide 30 percent by volume and subsequently 100 grams of ⅛ inch stainless steel shot was added thereto. This mixture was placed on a shaker for 1 hour and subsequently there was coated onto the interface layer a ½ mil wet thickness this coating being accomplished with a Bird applicator. Alternatively, with the incorporation of the DuPont polyester 49,000 in the mixture, the coating is made on the substrate. After drying at room temperature for 5 minutes there resulted a coating having a thickness of 2–4 microns.

This photoreceptor was charged in accordance with Example I and substantially similar results were obtained.

EXAMPLE V

There was prepared an overcoated photoreceptor in accordance with Example I with the exception that the injecting contact was prepared by dissolving 0.8 grams of purified polyvinylcarbazole in 14 milliliters of tetrahydrofuran:toluene in a 2 ounce jar. To this was added 1.78 grams of tellurium resulting in a 30 volume percent tellurium being present. To this was added 100 grams of ⅛ inch stainless steel shot and this mixture was placed on a paint shaker for 1 hour. Subsequently this mixture was coated with a Bird applicator to a ½ mil wet thickness on the interface layer. Alternatively, with the incorporation of the DuPont polyester 49,000 in the mixture, the coating is made on the substrate. The mixture was allowed to dry at room temperature for 5 minutes resulting in a dry thickness of 2–4 microns.

The photoreceptor was then charged in accordance with Example I and substantially similar results were obtained.

EXAMPLE VI

An overcoated photoreceptor was prepared in accordance with Example I with the exception that the injecting contact was prepared by dissolving 0.8 grams of purified polyvinylcarbazole and 14 milliliters of tetrahydrofuran:toluene in a 2 ounce jar. To this was added 1.63 grams of arsenic (or 1.18 grams of $As_2O_2$) resulting in a 30 percent volume. To this was added 100 grams of ⅛ inch stainless steel shot and this mixture was placed on a paint shaker for 1 hour. Subsequently there was coated on the interface with a Bird applicator a ½ mil wet thickness of this mixture. Alternatively, with the incorporation of the DuPont polyester 49,000 in the mixture, the coating is made on the substrate. After drying at room temperature for 5 minutes there resulted a thickness of 2–4 microns.

This photoreceptor was charged in accordance with Example I and substantially similar results were obtained.

EXAMPLE VII

An overcoated photoreceptor was prepared in accordance with Example I with the exceptions that the interface layer was eliminated and the injecting contact was prepared by dissolving 0.8 grams of DuPont 49,000 adhesive in 14 milliliters of 1:1 tetrahydrofuran:toluene in a 2 ounce bottle. To this was added 100 grams of ⅛ inch stainless steel shot and 1.13 grams $SeO_2$, 30 percent by volume. The mixture was placed on a shaker for 1 hour and subsequently was coated onto the substrate a ½ mil wet thickness layer with a Bird applicator. After drying there resulted a 2–4 micron dry thickness.

EXAMPLE VIII

An overcoated photoreceptor was prepared in accordance with Example I with the exception that the overcoating insulating layer was prepared by dissolving 3.0 grams of Makrolon polycarbonate in 34 milliliter of $CH_2Cl_2$. A 6 mil wet thickness coating is made on the generating layer with a Bird applicator which after drying resulted in a 12 micron dry thickness.

EXAMPLE IX

A 4 inch by 4 inch sample of the layered photosensitive image device of Examples I–III was used to produce a xerographic reproduction with a Xerox Model D processor and a good quality reproduction was obtained.

Although the invention has been described with respect to specific preferred embodiments, it is not intended to be limited thereto, but rather those skilled in the art will recognize that variations and modifications may be made therein which are within the spirit of the invention and the scope of the claims.

What is claimed is:

1. A layered photosensitive imaging device which comprises in the order stated:
   (a) a supporting substrate,
   (b) a hole injecting material capable of injecting holes into a layer on its surface, this material being selected from the group consisting of trigonal selenium, halogen doped trigonal selenium, selenium dioxide, arsenic, tellurium, arsenic selenium alloys, selenium tellurium alloys, and arsenic selenium tellurium alloys,
   (c) a hole transport layer in operative contact with the layer of hole injecting material, which transport layer comprises a combination of a highly insulating organic resin having dispersed therein small molecules of an electrically active material, the combination of which is substantially non-absorbing to a visible light but allows injection of photogenerated holes from a charge generator in contact with the hole transport layer and electrically induced holes from the layer of an injecting material, said electrically active material dispersed in said insulating organic resin is a nitrogen containing compound of the formula:

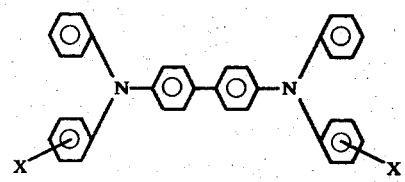

wherein X is selected from the group consisting of (ortho) $CH_3$, (meta) $CH_3$, (para) $CH_3$, (ortho) Cl, (meta) Cl, (para) Cl,
   (d) a layer of charge generating material in operative contact with the charge transport layer, said generating material being X-metal free phthalocyanine or vanadyl phthalocyanine, and
   (e) a layer of insulating organic resin overlaying the layer of charge generating material.

2. An imaging member in accordance with claim 1 wherein the transport layer contains from about 10 to about 25 percent of the nitrogen containing composition.

3. An imaging device in accordance with claim 2 wherein the transport layer is N,N'-diphenyl-N,N'-bis-(3-methyl phenyl)-[1,1'-biphenyl]-4,4'-diamine.

4. An imaging device in accordance with claim 1 wherein the substrate is aluminized mylar having a thickness of 5 mils, the adhesive layer is a polyester having a thickness of 0.05 microns, the hole injecting contact is selenium dioxide having a thickness of 3 microns, the generating layer is vanadyl phthalocyanine having a thickness of 3 microns and the overcoating layer is a polyester having a thickness of 12 microns.

5. An imaging device in accordance with claim 1 wherein the substrate is aluminized mylar having a thickness of 5 mils, the hole injecting contact is selenium dioxide having a thickness of 3 microns, the generating layer is x-metal free phthalocyanine having a thickness of 3 microns and the overcoating layer is polyester having a thickness of 12 microns.

6. An electrophotographic imaging method comprising using the imaging device of claim 1, charging this device with negative electrostatic charges, followed by charging the device with positive electrostatic charges in order to substantially neutralize the negative charge residing on the surface of the device, followed by exposing the device to an imagewise pattern of electromagnetic radiation to which the charge carrier generating material is responsive whereby there is formed an electrostatic latent image within the device.

7. A method in accordance with claim 6 including the step of forming a visible image by contacting the surface of the device with electroscopic marking particles.

8. A method in accordance with claim 6 wherein the transport layer is N,N'-diphenyl-N,N'-bis(3-methyl phenyl)-[1,1'-biphenyl]4,4'diamine.

9. A method in accordance with claim 6 wherein the injecting layer has a thickness of from about 2 to about 4 microns and the charge transport layer has a thickness of from about 20 to about 30 microns.

10. A method in accordance with claim 6 wherein the first polarity is negative and the second polarity is positive.

11. A method in accordance with claim 6 wherein the binder material used is selected from polyesters, polyvinylcarbazole, polycarbonates, and polyurethane materials.

* * * * *